US009814999B2

(12) United States Patent
Shaanti

(10) Patent No.: US 9,814,999 B2
(45) Date of Patent: Nov. 14, 2017

(54) AEROPHONE BUILDER

(71) Applicant: Rohan Shaanti, Toronto (CA)

(72) Inventor: Rohan Shaanti, Toronto (CA)

( * ) Notice: Subject to any disclaimer, the term of this patent is extended or adjusted under 35 U.S.C. 154(b) by 0 days.

(21) Appl. No.: 15/045,196

(22) Filed: Feb. 16, 2016

(65) Prior Publication Data

US 2016/0158661 A1 Jun. 9, 2016

Related U.S. Application Data

(63) Continuation-in-part of application No. 14/466,048, filed on Aug. 22, 2014, now Pat. No. 9,415,324.

(60) Provisional application No. 62/116,999, filed on Feb. 17, 2015.

(51) Int. Cl.

| | |
|---|---|
| ***A63H 33/30*** | (2006.01) |
| ***A63H 33/08*** | (2006.01) |
| ***G10D 9/00*** | (2006.01) |
| ***A63H 5/00*** | (2006.01) |
| ***A63H 33/04*** | (2006.01) |

(52) U.S. Cl.

CPC ..... *A63H 33/08* (2013.01); *A63H 5/00* (2013.01); *A63H 33/042* (2013.01); *A63H 33/086* (2013.01); *G10D 9/00* (2013.01)

(58) Field of Classification Search

USPC ... 446/71, 81, 397, 404, 418, 419, 421, 408; 84/470 R, 476

See application file for complete search history.

(56) References Cited

U.S. PATENT DOCUMENTS

| | | | | | |
|---|---|---|---|---|---|
| 3,924,348 | A * | 12/1975 | Taylor | A63H 33/088 | 446/102 |
| 4,651,613 | A * | 3/1987 | Harrison | G10F 1/06 | 434/159 |
| 5,897,417 | A * | 4/1999 | Grey | A63H 33/062 | 403/340 |
| 6,066,025 | A * | 5/2000 | Wisniewski | A63H 5/00 | 104/DIG. 1 |
| 6,132,281 | A * | 10/2000 | Klitsner | A63H 33/042 | 446/397 |
| 6,271,453 | B1 * | 8/2001 | Hacker | G09B 15/003 | 434/171 |

(Continued)

*Primary Examiner* — Kurt Fernstrom

(74) *Attorney, Agent, or Firm* — Nasser Ashgriz; UIPatent Inc.

(57) ABSTRACT

Aerophone toy building blocks to make a plurality of combination of sounds comprising of a plurality of building blocks, each the block having four walls, a top lid and a bottom cap to make a body having an inner space; at least two of the walls, the lid and the cap having releasable couplers; each the block having aerophone musical instruments to produce sounds; each the block having a plurality of airway channels inside the inner space, the airway channels are connected to the adjacent airway channels; the blocks having the same or different sizes, whereby larger blocks create lower pitched sounds, while smaller blocks create higher pitched sounds; the blocks having the same or different materials to let the instrument produce different sounds; the musical instrument being mounted either onto or inside of the body of the building block, or being permanently encased within the material of a block; and an air source to be attached to the plurality of building blocks to provide an air flow to each aerophone instrument.

19 Claims, 15 Drawing Sheets

(56) References Cited

U.S. PATENT DOCUMENTS

| | | | | |
|---|---|---|---|---|
| 6,353,168 | B1 * | 3/2002 | Sosoka, Jr. | G10H 1/0008 446/397 |
| 6,672,930 | B1 * | 1/2004 | McElhaney | A63H 29/16 446/178 |
| 7,956,271 | B1 * | 6/2011 | Jonas | G09B 15/00 84/476 |
| 8,420,923 | B1 * | 4/2013 | Choi | G10H 1/32 84/476 |
| 9,205,343 | B1 * | 12/2015 | Wisniewski | A63H 5/00 |
| 9,415,324 | B2 * | 8/2016 | Shaanti | A63H 33/042 |
| 2013/0165012 | A1 * | 6/2013 | Klauber | A63H 33/062 446/91 |

* cited by examiner

AEROPHONE BUILDER

RELATED APPLICATION

This application claims the priority date of provisional patent application No. 62/116,999 filed Feb. 17, 2015, and repeats a substantial portion of prior application Ser. No. 14/466,048, filed Aug. 22, 2014, and adds and claims additional disclosure not presented in the prior application. Since this application names the inventor or at least one joint inventor named in the prior application, it may constitute a continuation-in-part of the prior application.

FIELD OF THE INVENTION

The present invention relates to buildable instruments having coupling means while being able to make different sounds.

BACKGROUND OF THE INVENTION

Different types of toy bricks or blocks are available, which are used to build a variety of structures. These bricks or building blocks have different coupling means, different sizes and shapes. For instance, LEGO, K'NEX and MEGA BLOKS brands provide a variety of designs attempting to motivate children and adults to develop new ideas and concepts with the help of building elements. Novel concepts are being implemented on these building blocks. For instance, there is a toy building block that makes a doorbell sound.

SUMMARY OF THE INVENTION

The present invention is a buildable aerophone musical instrument having coupling abilities, and able to make different sounds through various assemblies. Each piece has its own musical instrument and can be joined together to create an instrument that is activated by air-flow. Pieces containing reeds, membranes, or holes help to create sounds that the user can manipulate. Spring valves may be attached over reeds or holes to help user control air-flow. Air can be provided from the user's breath, a foot pump, a hand pump, natural airflow, or from a compressed-air module.

The instrument can create the sounds of saxophones, clarinets, trumpets, trombones, tubas, melodicas, harmonicas, flutes, ocarinas, kazoos, whistles, didgeridoos, bagpipes and accordions; independently or simultaneously, depending on how the user assembles the device. Horns and horn mutes of the present invention are used to amplify or manipulate sounds.

Various mouthpieces can be used to achieve the sound the user is wishing to create; such as reed bearing mouth pieces, horn instrument mouth pieces, membrane bearing mouthpieces, tubular round mouth pieces, flat mouthpieces, hallow mouthpieces, etc. Multiple mouthpieces may be assembled to the constructed instrument, allowing a user to pick their sound, and also allowing for multiple participants to play the instrument at the same time.

Air-flow between instruments, can be turned on or off with valves or buttons that are assembled and activated by the user. Instrument notes can change with the sliding of tubes to extend or contract length, or the opening and closing of valves or holes to manipulate air-flow. The present invention can install on a floor, on a table, or can be fastened to another instrument, and held by the user, or fastened to the user.

Air-pressure gauges and air-containment bags of the present invention provide additional musical options for users, such as creating drone sounds, while teaching users about air pressure and general pneumatics.

The present invention allows users to build multi-faceted aerophone musical instruments with customized visual designs and sounds.

The building instruments of the present invention have other attaching means to connect to each other or external devices, such as straps. Attachment means such as Velcro, clips, strings, magnets, grooves, loops and buttons are used to attach the present device to each other or other external surfaces.

The present invention promotes creativity and imagination, letting a user make different musical instruments and compose music with his/her own original sounds. These elements can be used to teach users how music is produced and how different kinds of sound making material can affect each other. By having such musical elements, users can compose their own music and invent different kinds of sound combinations.

This invention has been designed to teach the principles of music composition and to help with music development for users of all ages. It can be used in many areas of a sound and music school curriculum or music therapy, at a recording studio and for live musical performances.

The present invention is great for developing social collaboration between users and for encouraging them to use music language. It helps children develop a deeper understanding of different musical instruments and a further knowledge of how sounds are produced based.

It is the other objective of the present invention to provide a device for users to become systematically creative music learners. This can be done by combining different types of musical instruments with playfulness and imagination, giving form to their thoughts of musical sound ideas.

Other objects, features, and advantages of the present invention will be readily appreciated from the following description. The description makes reference to the accompanying drawings, which are provided for illustration of the preferred embodiment. However, such embodiments do not represent the full scope of the invention.

BRIEF DESCRIPTION OF THE DRAWINGS

Embodiments herein will hereinafter be described in conjunction with the appended drawings provided to illustrate and not to limit the scope of the claims, wherein like designations denote like elements, and in which:

DETAILED DESCRIPTION OF THE DRAWINGS

The musical instrument comprises of a plurality building block toys to make a combination of sounds. Each block has four side walls, a top wall and an open bottom. Each side wall comprises of holes connected to the airways inside the blocks to build an inner space with an air flow. Each of the blocks have the same or different sizes, whereby the larger blocks create lower pitched sounds, while smaller blocks create higher pitched sounds. The blocks have the same or different materials to let the instrument produce different sounds.

The musical instrument of the present invention can be mounted either onto or inside of the body of the building block, or permanently encased within the material of a block.

Figure 1A:
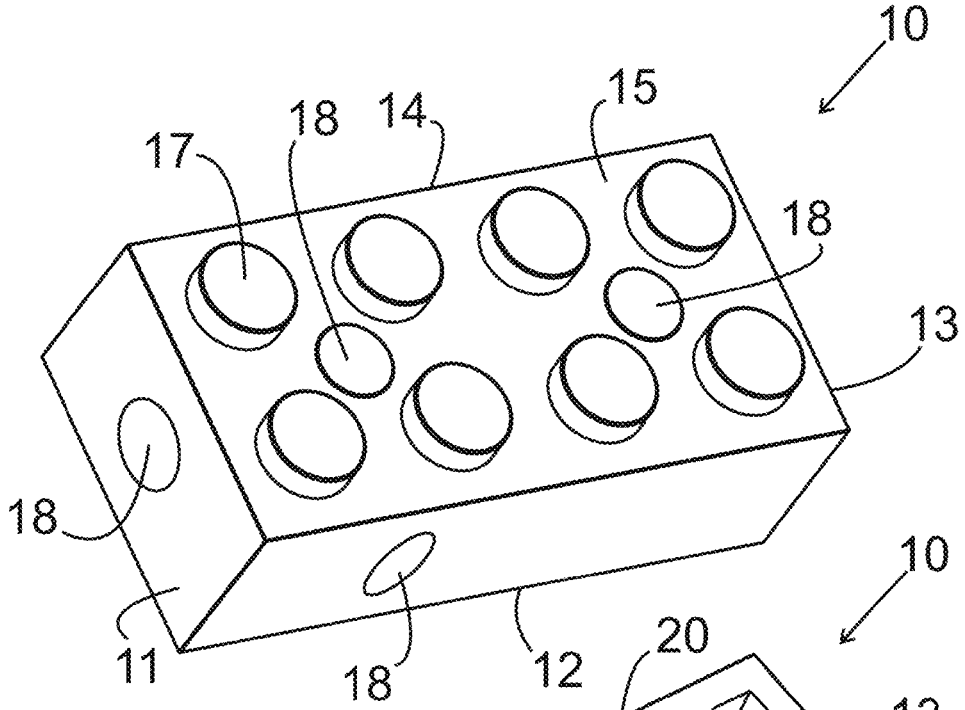
FIG. 1A illustrates a perspective view of an example of a musical toy brick designed for the present invention.
Figure 1B:
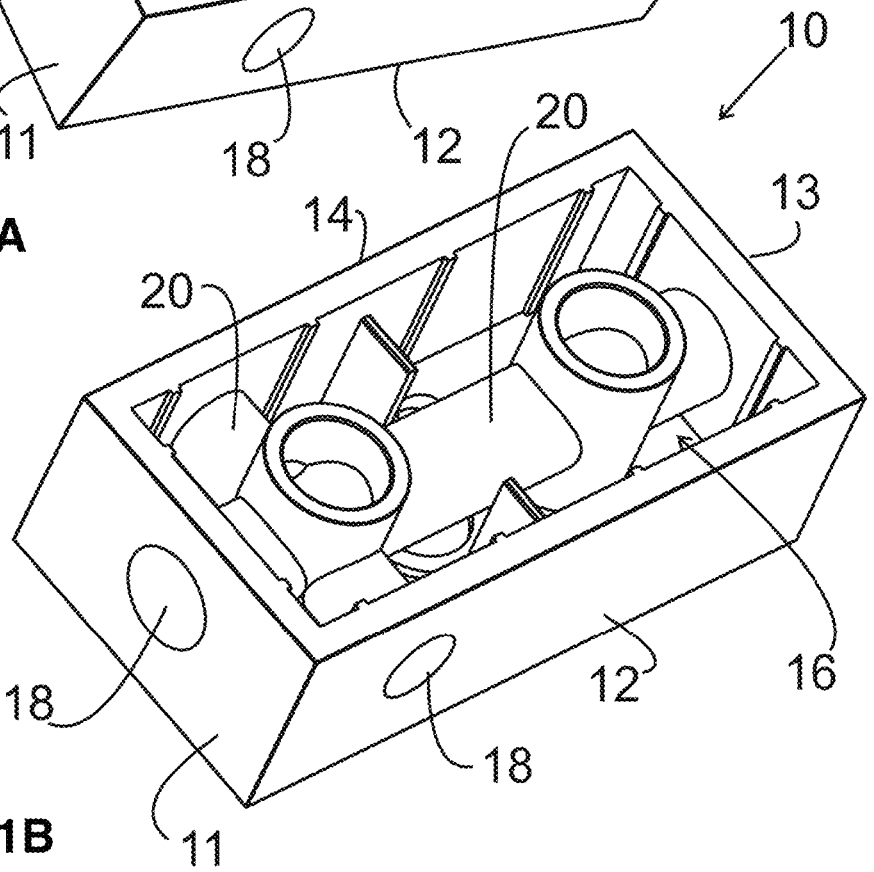
FIG. 1B illustrates a perspective view of an example of a musical toy brick designed for the present invention.
Figure 2:
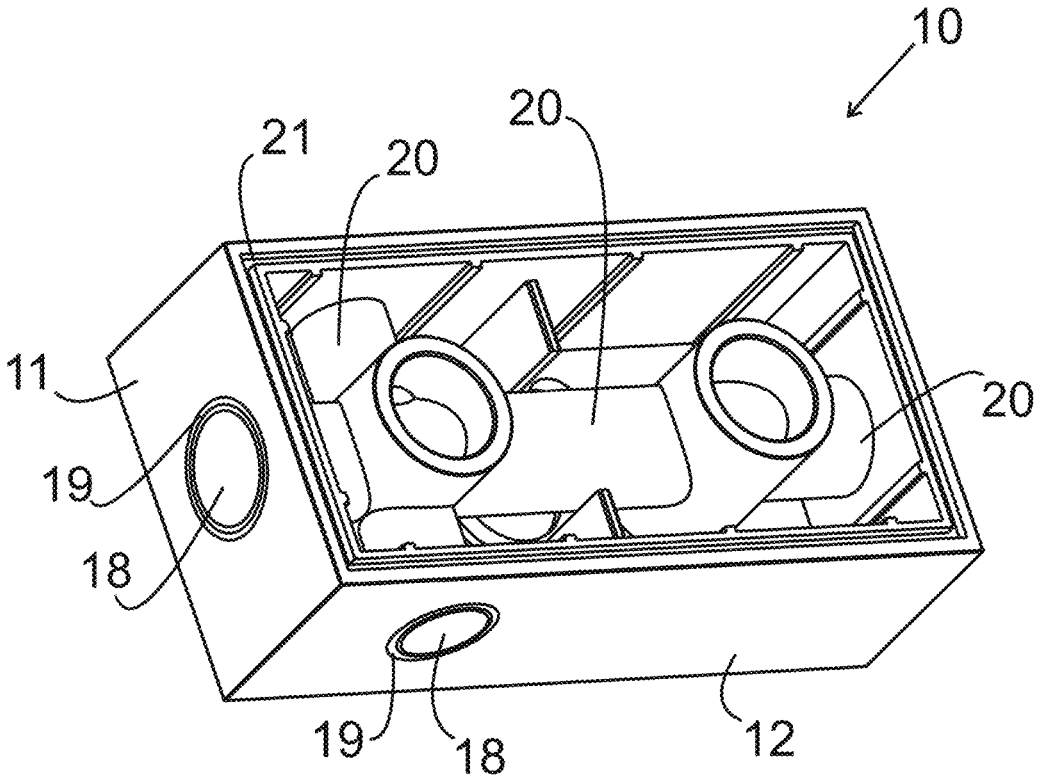
FIG. 2 illustrates the back side of a musical toy brick designed for the present invention.

A building block element of the present invention is shown in FIGS. 1A, 1B and FIG. 2. The building block 10 of the present invention comprises of four side walls 11-14, a top wall 15 and a bottom 16. The top wall 15 comprises of a plurality of couplings 17 having the ability to connect to the other blocks in various shapes or receive separate pieces of building block musical instruments to make different sounds through various assemblies.

The coupling 17 can be designed in side walls 11-14 of the building block of the present invention to connect the building elements from side wall.

The side walls 11-14 and a top wall 15 comprising of a plurality of apertures 18 connected to the air way system 20 in the inner part of the building block 10. This enables the flow of the air into the block 10. The airways 20 of the adjacent blocks in the aerophone building block instruments will be connected to each other to deliver a substantially continuous stream of air to the reeds or other musical elements.

Tone-blocks of the present invention are blocks with special holes of different shapes and sizes. Apertures 18 may vary in sizes and shape. Tone-blocks may have no holes, one hole, or multiple holes. Sounds and amplification vary depending on the size of the hole and the thickness of the material of the block. Tone-blocks can be mounted onto the body of the building blocks of present invention or made within the material of a block.

The diameter of the apertures 18 in the side walls 11-14 and top wall 15 is adapted to receive the connecting walls. The wall may be equipped with a Velcro to help the building block to attach to a receiving Velcro surface on another block or fabric. Wall may be equipped with a magnet to help the building block attach to the metallic surface or other building blocks with a magnetic wall.

FIG. 1B and FIG. 2 shows the inner portion of the building block 10 of the present invention. Each aerophone musical instrument produces sound when air passes through an element that vibrates. The airway system 20 provides air to each building block 10 from an air source. The airway system 20 of each building block 10 connects to each other to direct air flow to the specific aerophone instrument.

The airway channel 20 comprises of air tubes installed inside each building block 10 of the present invention. The building block 10 of the present invention can connect to another building block from the side walls 11-14 or the top wall 15 to produce an aerophone platform for the present invention. An aerophone instrument of the present invention can attach to the aerophone platform of the present invention.

As shown in FIG. 2, a plurality of grooves 19 is designed on the bottom part and on the airway channel 20 to provide a sealed chamber for the aerophone instrument of the present invention. A washer sized to receive inside the grooves 19 prevents any air leakage between two building block. There are also connecting grooves 21 on bottom edge of the building block 10 to seal the joined blocks.

A louder sound can be achieved, by using a larger building block or increasing air stream velocity.

Figure 3:
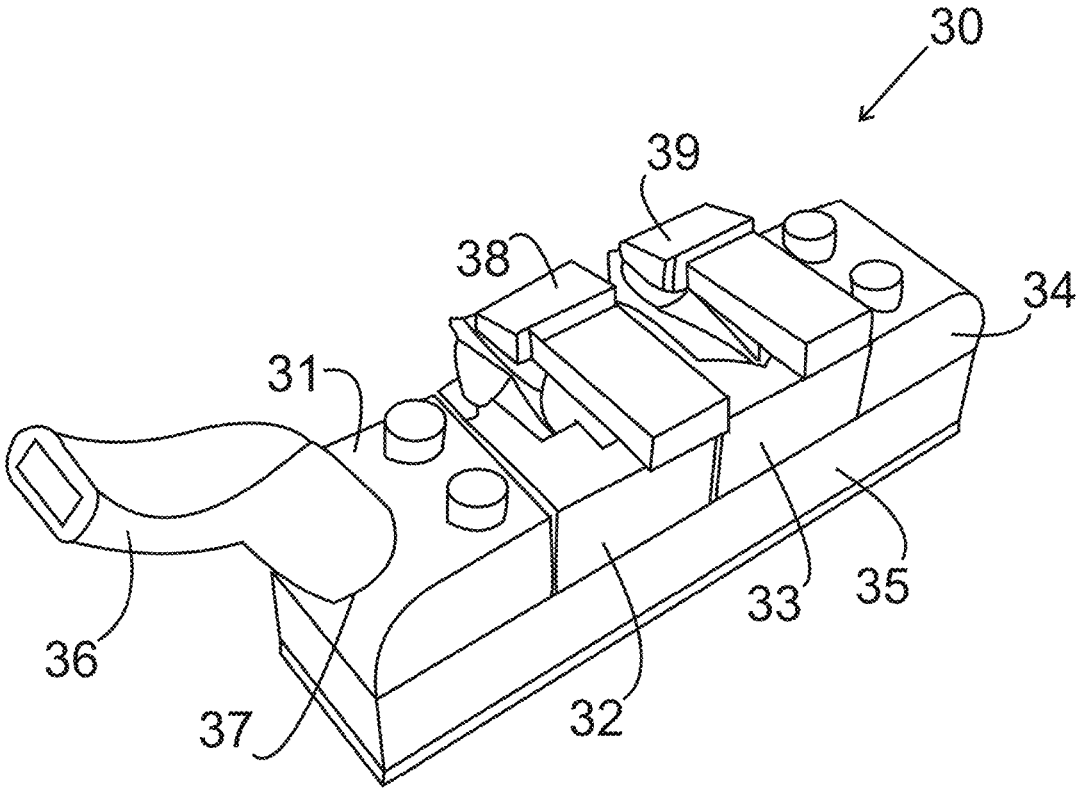
FIG. 3 shows an example of the present invention assembled as a melodica.

As shown in FIG. 3, the aerophone instrument of the present invention is a melodica 30, which is a free-reed instrument similar to the pump organ and harmonica. The musical instrument 30 comprises of a plurality of building blocks each shaped to receive detachable pieces to create the musical instrument that is activated by airflow. A first building block 31 has an opening 37 to receive a detachable mouth piece 36.

The melodica instrument 30 includes a series of building blocks 32, 33 as detachable reeds aligned side by side which assume a key board construction. The reeds have keys on the top 38, 39 which open and close by a spring hinged mechanism. An end block 34 is attached to the end part of the instrument 30. The musical instrument 30 is played by blowing air through the mouthpiece 36 that fits into the hole 37 in the side of the instrument 30.

The reed block assembly 32, 33 comprises of a slot assembled under the keys 38, 39. Pressing the keys 38, 39 block a portion of the slot and generate a sound when the air passes through the slot. The number of the reed blocks that are used, serve the number of octaves required in the instrument. In any event, when the keys are selectively depressed by the fingers, the corresponding reeds will be lifted so as to uncover selective reed slots. The air under pressure will then flow through the reed slot and generates the desired tone.

Reed block assembly blocks 32, 33 can be removed from instrument base block 35 and be reassembled to the base with different positioning, allowing the user to choose where they want the note to be located.

Various mouthpieces can be used to achieve the sound that the user is wishing to create; such as reed bearing mouth pieces, horn instrument mouth pieces, membrane bearing mouthpieces, tubular round mouth pieces, flat mouthpieces, hallow mouthpieces, etc. Multiple mouthpieces may be assembled to the constructed instrument, allowing a user to pick their sound, and also allowing for multiple participants to play the instrument at the same time. Instrument notes can change by the different types of airflows directed through the various mouthpieces.

Again referring to FIG. 3, melodica instrument 30 comprises of a base block 35 adapted to receive the detachable mouthpiece block 31, detachable reeds 32, 33 and other instrument elements.

In melodica instrument, the keyboard is usually two or three octaves long. Soprano and alto melodicas are higher-pitched and thinner sounding than tenors. This possibility can be achieved in building block melodica by using the blocks in different sizes, whereby the larger blocks create lower pitched sounds, while smaller blocks create higher pitched sounds. Some building block melodica are designed to be played with both hands at once. Others are played like the tenor melodica.

Figure 4:
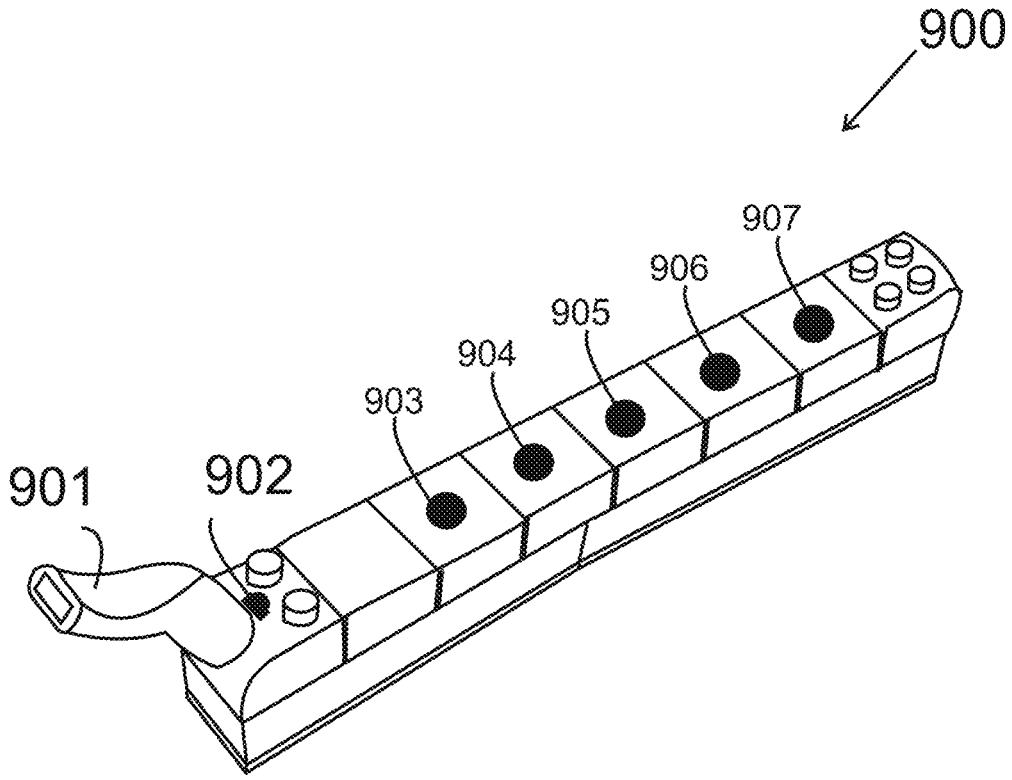
FIG. 4 shows an example of the present invention assembled as a flute.

The flute building element shows in FIG. 4. The flute instrument 900 is an aerophone musical instrument that produces its sound from the flow of air across an opening 901. A flute 900 produces sound when a stream of air directed across a hole 902 in the instrument creates a vibration of air at the hole 902. This excites the air contained in the usually cylindrical resonant cavity within the flute. The player changes the pitch of the sound produced by opening and closing holes 903-907 in the body of the instrument 900, thus changing the effective length of the resonator and its corresponding resonant frequency. The flute 900 of the present invention can produce harmonies in different proportions or intensities. Holes 903-907 can be replaced or covered with muting blocks that do not contain air-holes.

Figure 9:
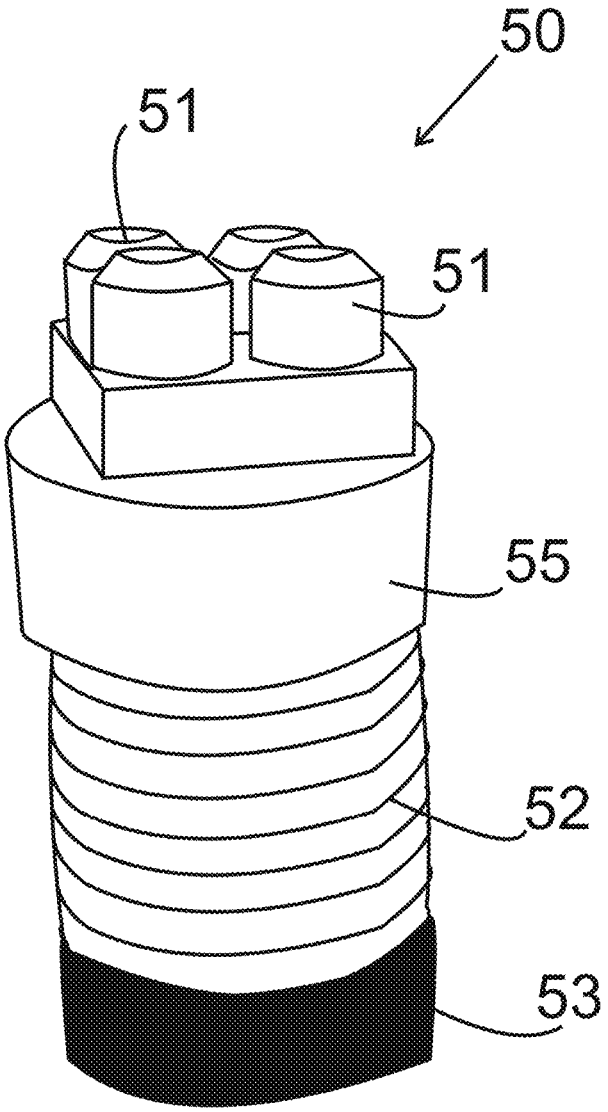
FIG. 9 illustrates an example of a hand pump operated instrument of the present invention with reeds located under couplers on top, a bendable hose in the middle, and a shaker at the end.

The accordion building element, is an aerophone instrument using the same mechanism as a melodica with combination by a hand pump instrument as shown in FIGS. 3 and 9. The instrument is played by compressing or expanding the bellows while pressing buttons or keys, causing pallets to open, which allow air to flow across strips of reeds that vibrate to produce sound inside the body.

Figure 5:
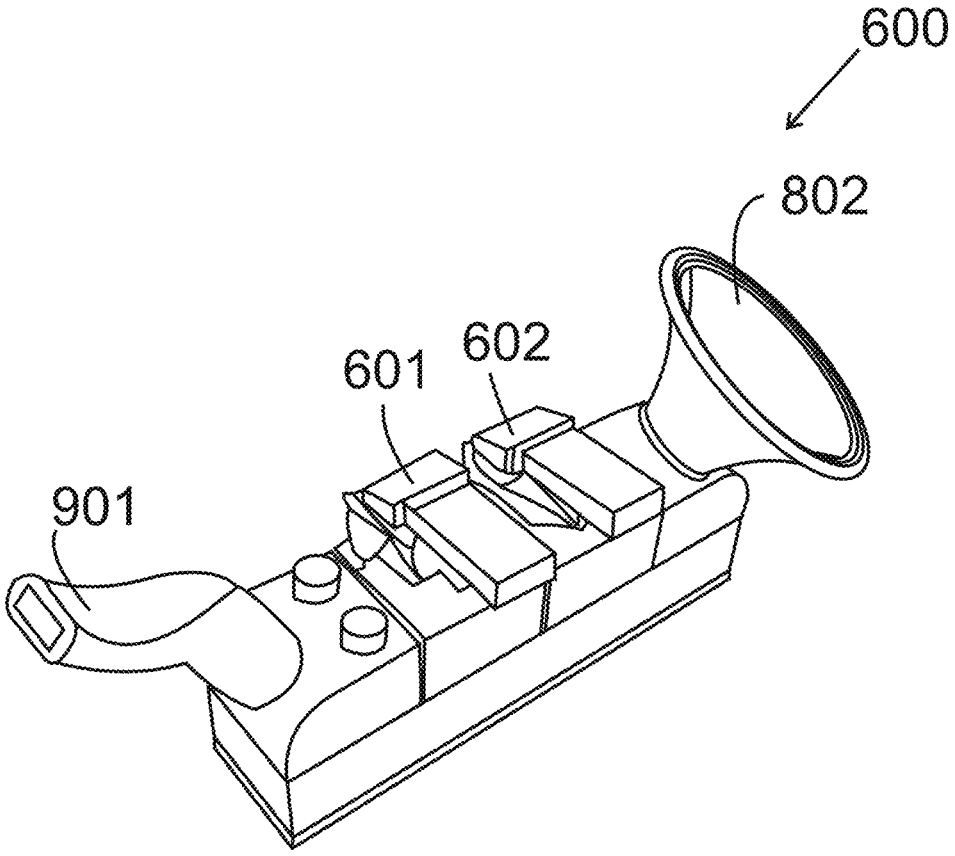
FIG. 5 shows an example of the present invention assembled as a saxophone instrument, a trumpet instrument, a trombone instrument, a tubas instrument and a clarinet instrument.
Figure 6:
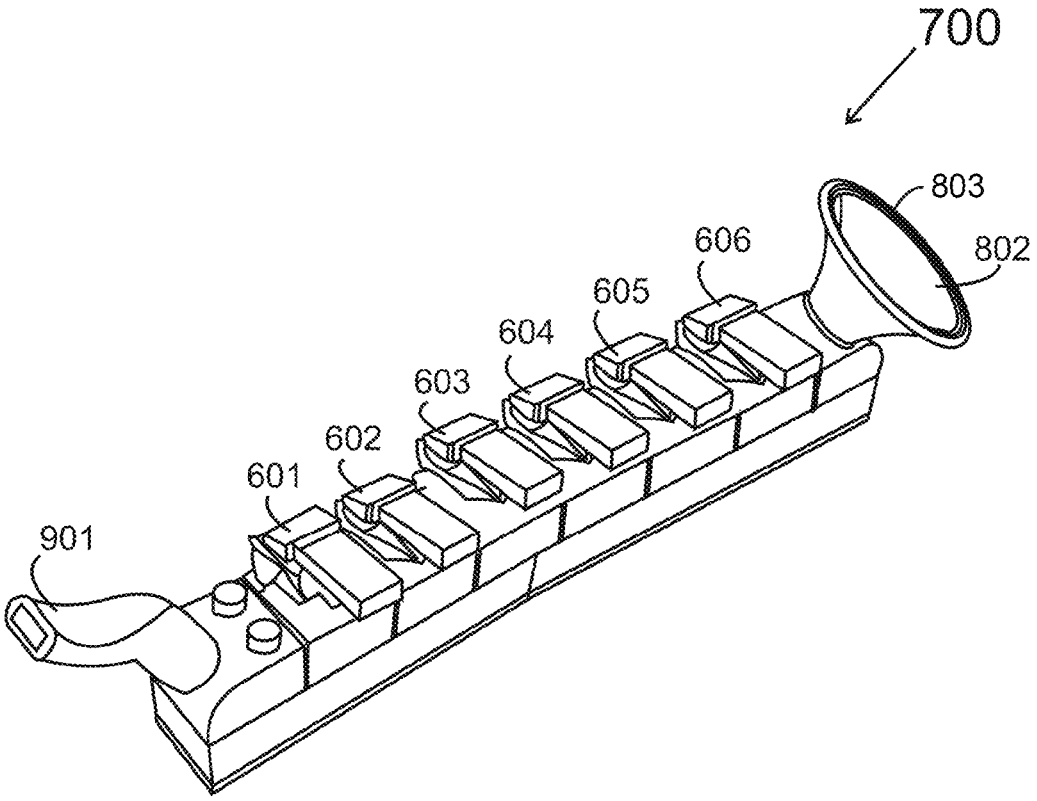
FIG. 6 shows an example of the present invention assembled as a saxophone instrument, a trumpet instrument, a trombone instrument, a tubas instrument and a clarinet instrument.
Figure 7:
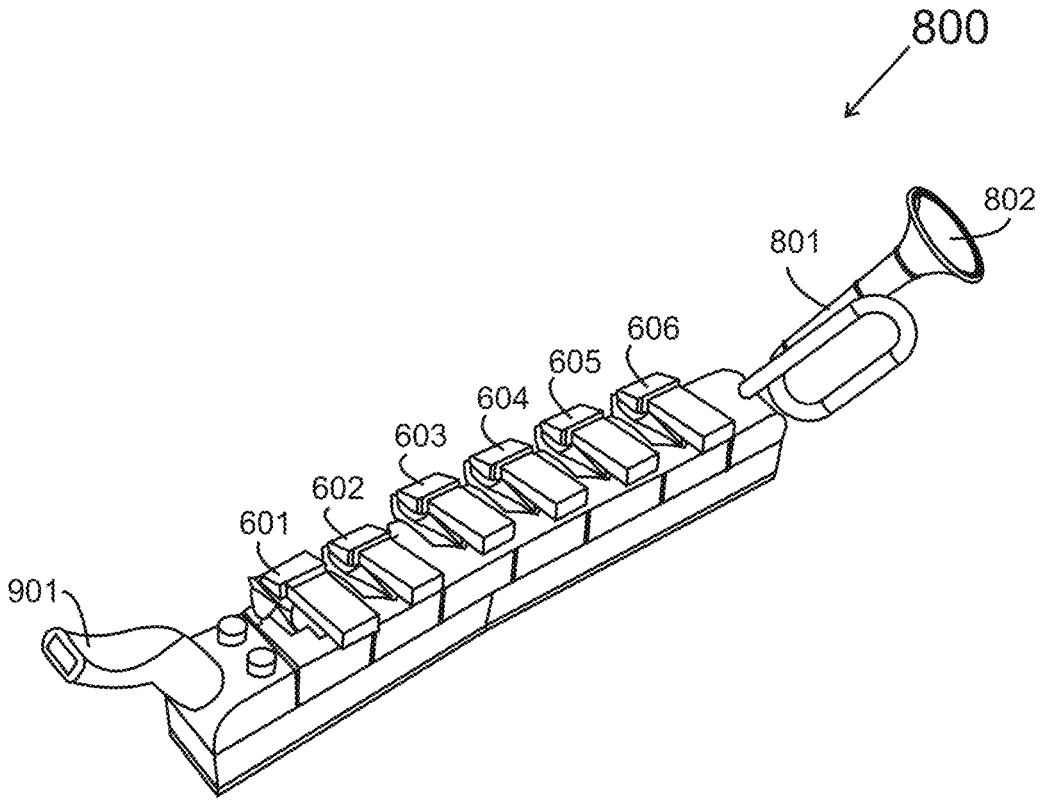
FIG. 7 shows an example of the present invention assembled as a saxophone instrument, a trumpet instrument, a trombone instrument, a tubas instrument and a clarinet instrument.

Resembling of a saxophone instrument, a trumpet instrument, a trombone instrument, a tubas instrument and a clarinet instrument of the present invention are shown in FIGS. 5-7. The instruments 600, 700 and 800 comprising of a plurality of tone holes of varying size wherein these holes are covered by a plurality of keys 601-606.

As shown in FIG. 6, a flexible translucent membrane 803 is attached over the air exit horn 802, when it vibrates, the membrane creates the sound of a saxophone or drone. The airflow of assembled instrument 700 is manipulated by the reeds or air holes covered by plurality of keys 601-606.

As shown in FIG. 7, a U-bend tube 801 is attached to the end of the building block instrument 800. A horn-shaped end 802 is attached to the distal end of the U-bend 801 to regulate the air flow and make a strong sound.

Figure 8:
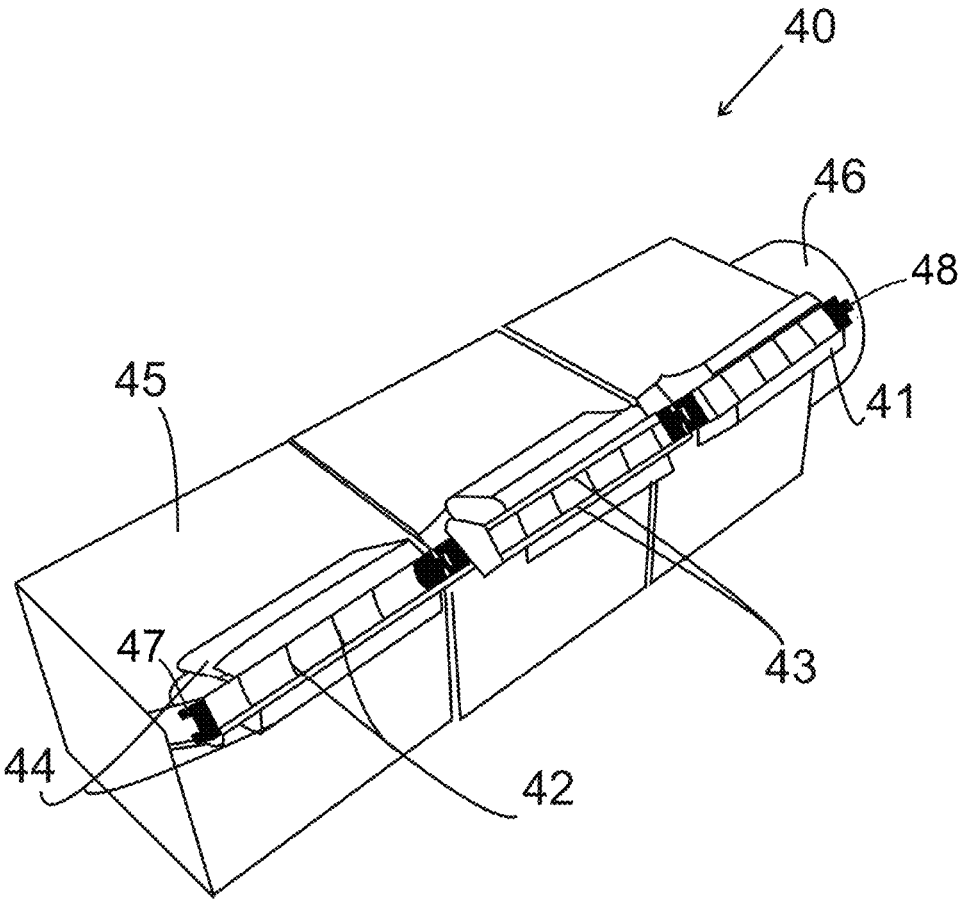
FIG. 8 illustrates an example of harmonicas of the present invention.

The harmonica instrument is a free reed wind instrument which is played by using the mouth to direct air into and out of one or more holes along a mouthpiece. Behind the holes are chambers containing at least one reed. As shown in FIG. 8, a harmonica instrument 40 is attached to an outer edge of a building element. The instrument comprises of a mouth piece 41. The mouth piece 41 comprises comb 42, reed-plates 43 and cover-plates 44. Reed is a flat elongated spring which is secured at one end over a slot that serves as an airway. When the free end is made to vibrate by the player's air, it alternately blocks and unblocks the airway to produce sound.

Again referring to FIG. 8, the harmonica instrument 40 has coupler 46 on one end, so that sets of reed blocks 45 can be added to the instrument. The reed blocks 45 can be arranged side by side according to the notes of different musical scores or selections for rendering different tunes. The building harmonica 40 can be made with any number of reed blocks 45.

FIG. 9 illustrates a hand pump musical instrument 50 having a series of reeds located underneath of a plurality of couplers 51 on top of the building blocks. The hand pump musical instrument 50 comprises of a circular top 55, a bellows 52 in the middle for producing compressed air and a shaker 53 at the bottom. The bellows 52 is engaged with the reed portion of the hand pump musical building instrument. By pushing the reed portion 52 downwardly toward the bellows 52, the bellows 52 is compressed and the air flow through the airways of the building blocks toward the reed portion producing a tone or whistling sound.

Figure 10:
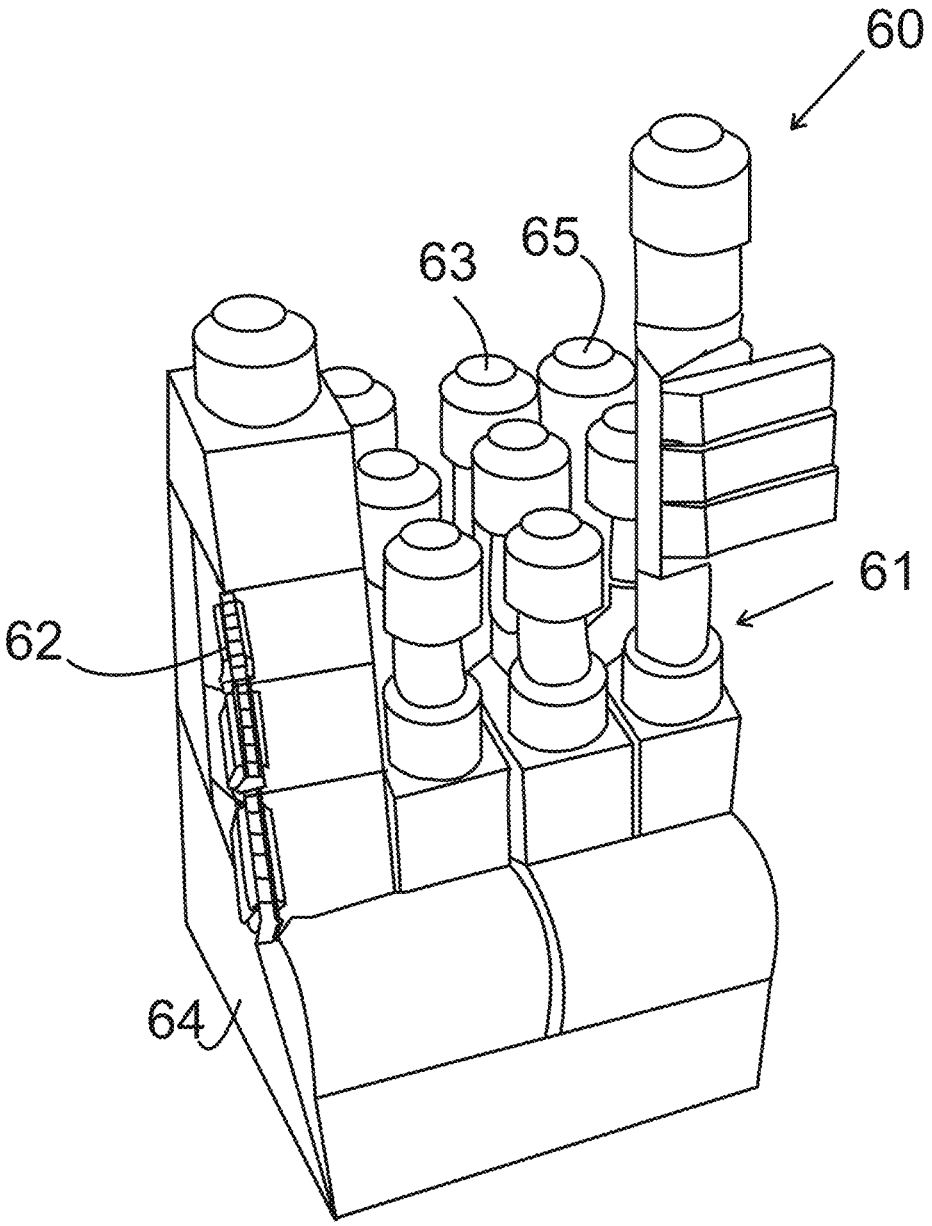
FIG. 10 illustrates an example of the present invention assembled with the ability to make the sounds of multiple instruments.

As shown in FIG. 10, the musical building element 60 comprises of multiple different instruments. Users can connect a plurality of building blocks together and make their own musical instrument with a unique sound that they can customize.

Again referring to FIG. 10, the musical instrument 60 comprises of a melodica building element 61, a harmonica building element 62 and plurality sound manipulating buttons 63 attached to couplers. Combination of these three instruments can be used to make a unique sound. The instruments 61-63 can be connected to the base block 64 in various way to navigate air to the instruments 61-63.

Further referring to FIG. 10, the musical instrument 60 allows for blocks 63 and 65 to be moved into different positions, allowing the user to pick where they want the notes or instruments to be located.

Figure 11:
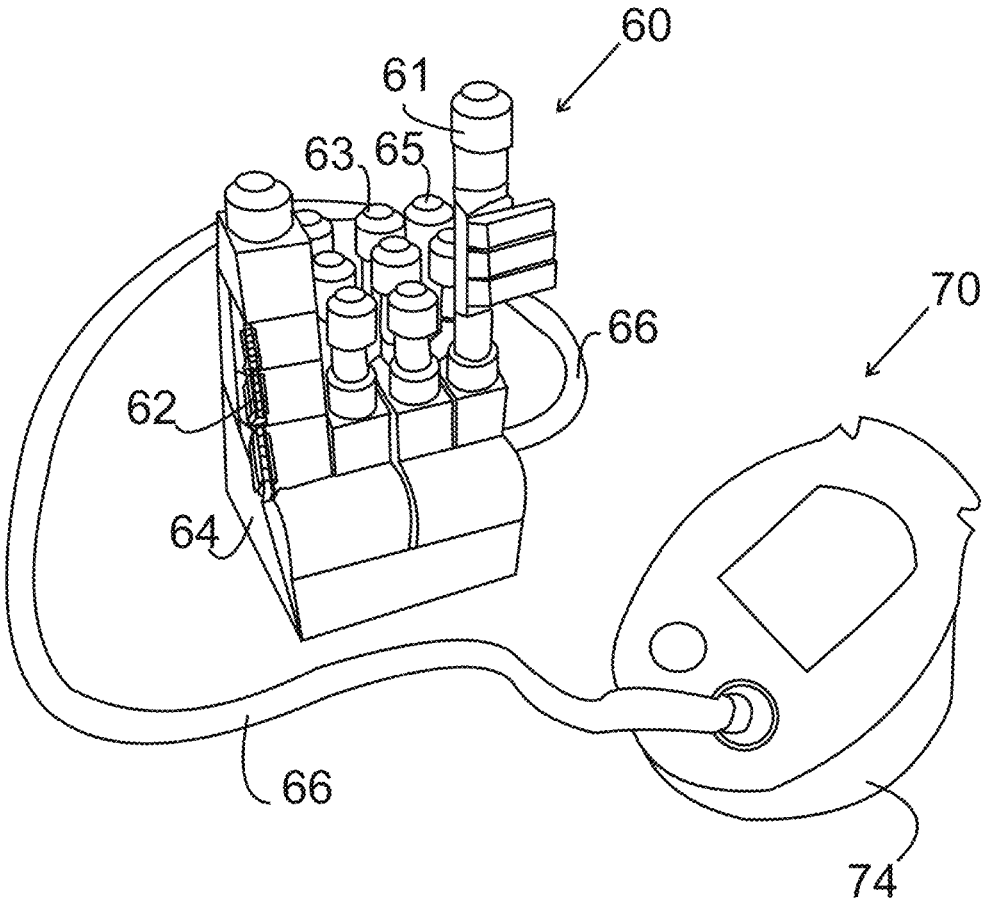
FIG. 11 illustrates an example of the present invention assembled as a foot pump operated instrument in combination of variety of assembled music instruments, with music notes, valves, and/or sound manipulating buttons attached to couplers.

FIG. 11 illustrates the musical instrument 60 with a foot pump 70. The foot pump 70 is connected to the base block 65 to create air flow for operating the instruments 61-63. The foot pump 70 is connected to the base block 65 with a hose 66 to provide an air steam for the instruments 61-63 to make sound.

Figure 12A:
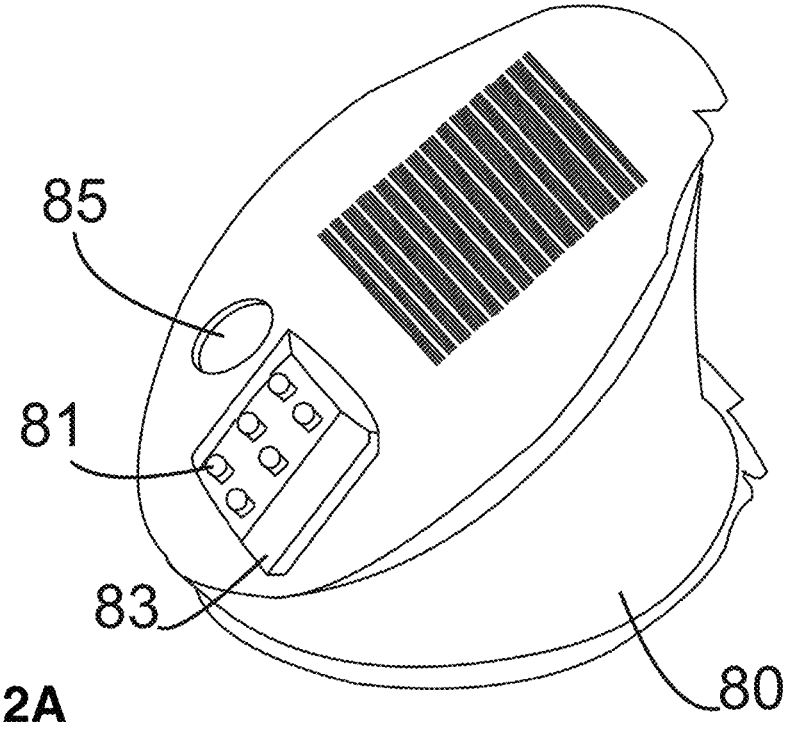
FIG. 12A illustrates a foot pump with a base for the present invention.
Figure 12B:
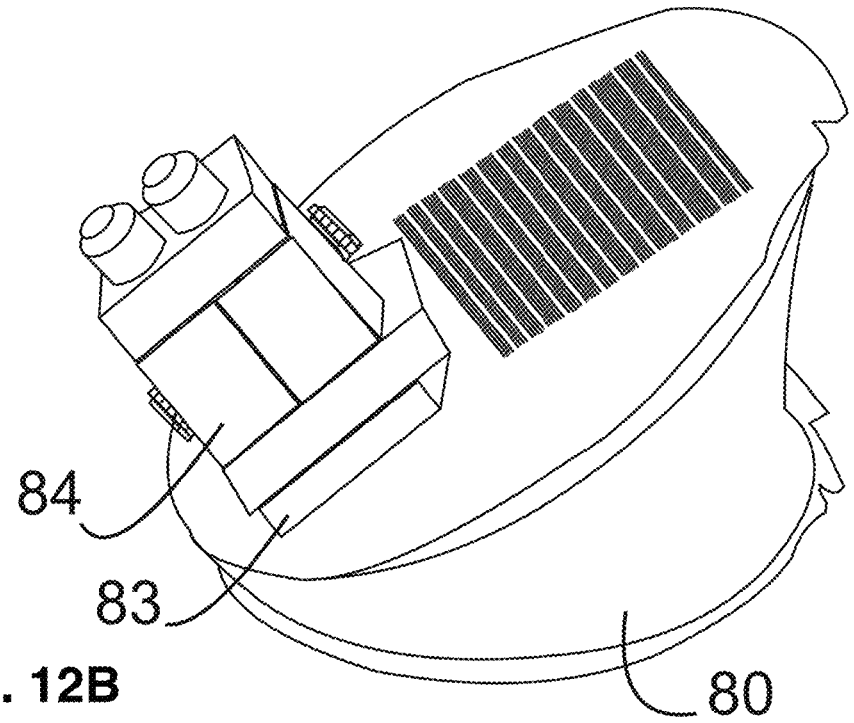
FIG. 12B illustrates an example of the present invention assembled an a foot pump operated instrument.

FIGS. 12A and 12B is a foot pump 80 that a coupling means 83 is attached to the body of the foot pump 80. By adding different aerophone musical instrument to the foot pump 80 through the coupling means 83 as shown in FIG. 12B, a plurality of aerophone instrument can be made. The aerophone instrument 84 can be operated by the foot pump 80. Any Aerophone building instrument such as melodica or harmonica building element can be used in combination with a foot pump 80. A base building block 83 is mounted onto the external surface 82 of the foot pump 81 to receive various aerophone building elements. FIG. 12B shows a foot pump building element 80 with a harmonica building element 84 attached thereon.

Figure 13:
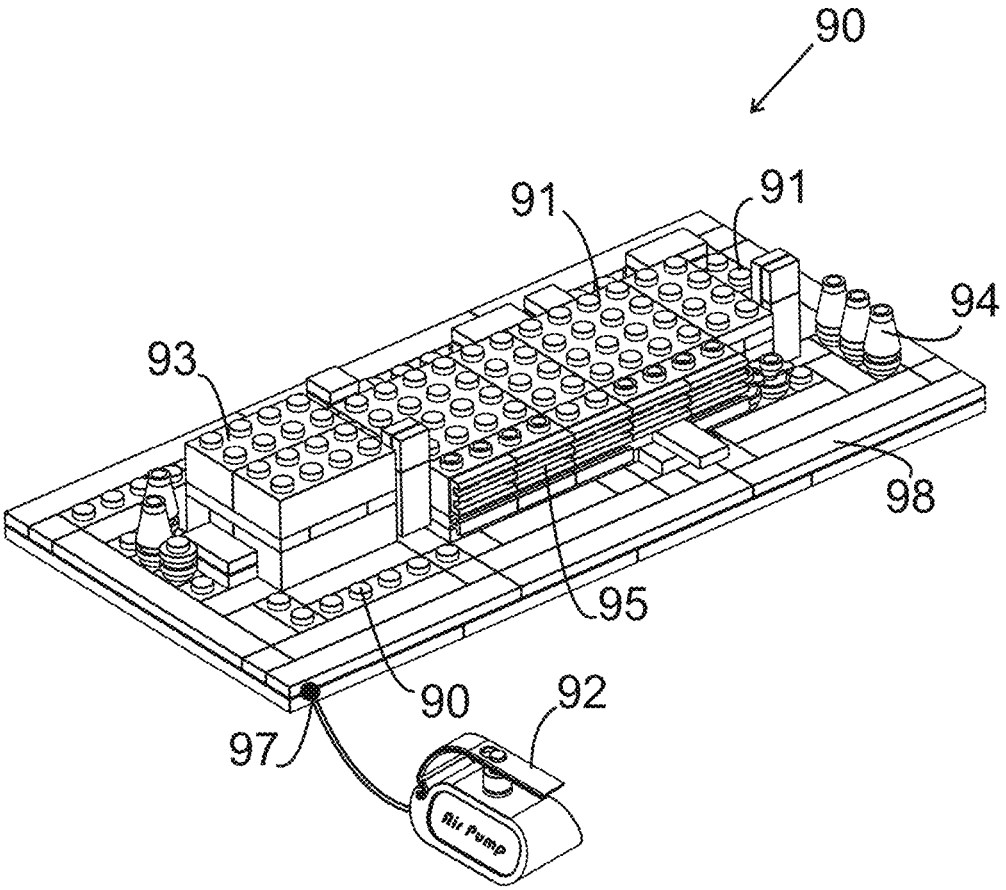
FIG. 13 illustrates an embodiment of the present invention assembled as a platform with the ability to receive multiple aerophone instruments.

FIG. 13 illustrates an embodiment of the present invention assembled as a platform 90 with the ability to receive multiple aerophone instruments to make various sounds. The platform 90 is built with a plurality of musical building blocks 91. Each musical building block 91 has its own airway channels and is connected by a plurality of couplers 99 to other musical building block 91. Tone blocks can be rectangular blocks 93, conical blocks 94 or bellow blocks 95. Air is provided through an air pump 92, or other sources such as a hand pump or a foot pump. Air source is applied through a hole 97 mounted on the wall of the base portion.

A plurality of tone blocks can be used to build and design a platform 90. Sounds and amplification may vary depending on the size of the blocks and holes and the thickness of the platform. Plain blocks 98 can also use to provide where adequate spaces is needed between the instruments on the platform.

Figure 14:
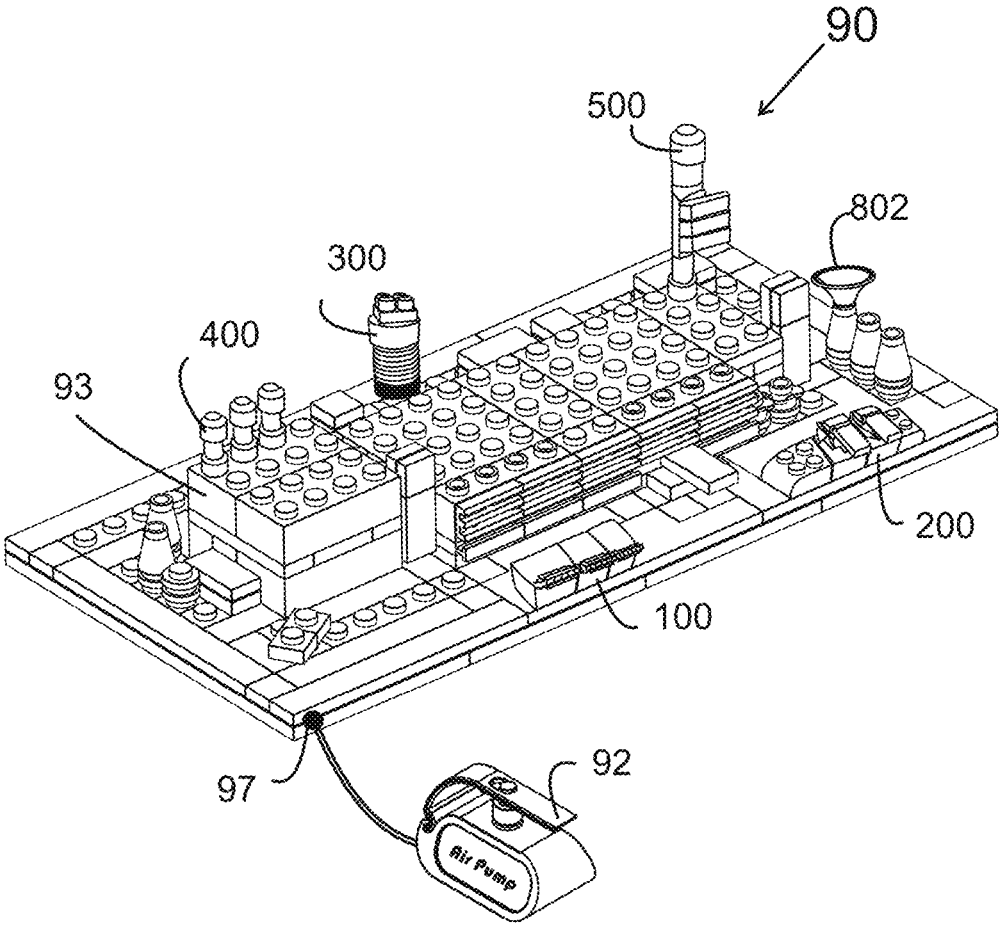
FIG. 14 illustrates an embodiment of the present invention assembled as a platform with the ability to receive multiple aerophone instruments.

FIG. 14 describes the platform illustrated in FIG. 13 in conjunction with various types of building instruments of the present invention. A harmonica building element 100, a melodica building element 200, a hand pump building instrument 300, sound manipulating buttons 400 and a flute building instrument 500 is attached to the platform. The user can play various types of music by pressing the air pump to deliver the air stream to the platform. As described the building blocks comprise of airways and holes to direct the air to the instruments. This system allows the users to design their own instruments which can be assembled to create a unique instrument.

Figure 15A:
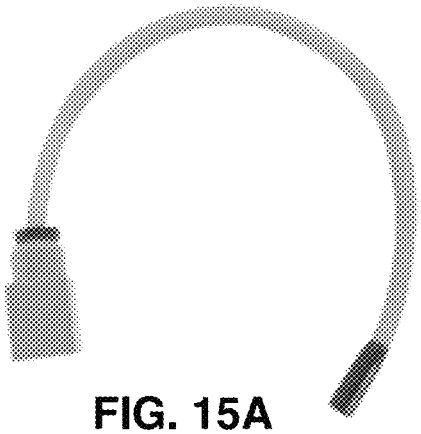
FIG. 15A illustrates a tubular mouthpiece embodiment of the present invention.

FIG. 15A illustrates a tubular mouthpiece that can attach to the present invention, creating an air-flow when the user exhales or inhales air through the mouthpiece.

Figure 15B:
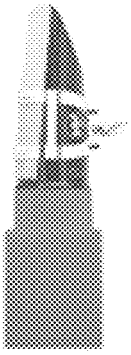
FIG. 15B illustrates a reed-mouthpiece embodiment of the present invention.

FIG. 15B illustrates a reed-bearing mouthpiece that can attach to the present invention, creating an air-flow with a distinct vibration that makes a unique sound when passing through the assembled instrument, ideal for creating a clarinet or saxophone sound. When user's lips are placed on reed-bearing mouthpiece and air is exhaled by the user, the reed vibrates, creating a sound that passes through the attached instrument.

Figure 15C:
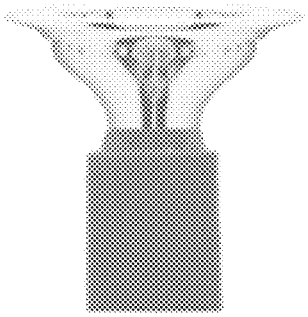
FIG. 15C illustrates a horn-mouthpiece embodiment of the present invention.

FIG. 15C illustrates a horn mouthpiece that can attach to the present invention, creating an air-flow with a distinct vibration that makes a unique sound when passing through the assembled instrument, ideal for creating a trumpet, or tuba sound. When user's lips are placed within the mouthpiece, and they exhale air while vibrating their lips, a sound is created that passes through the attached instrument.

Figure 15D:
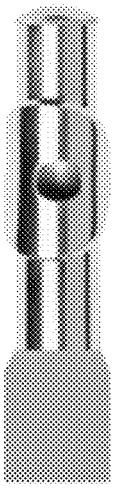
FIG. 15D illustrates a flute-mouthpiece embodiment of the present invention.

FIG. 15D illustrates a flute mouthpiece that can attach to the present invention, creating an air-flow with a distinct vibration that makes a unique sound when passing through the assembled instrument, ideal for creating a flute. When the user's lips are placed over the air hole with a slight gap, air flows over and through the mouthpiece, a sound is created that passes through the attached instrument.

The musical building block of the present invention can assembled in different shape and size to resemble different sound such as ocarinas instrument, kazoos instrument, didgeridoos instrument, and bagpipe instrument.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

With respect to the above description, it is to be realized that the optimum relationships for the parts of the invention in regard to size, shape, form, materials, function and manner of operation, assembly and use are deemed readily apparent and obvious to those skilled in the art, and all equivalent relationships to those illustrated in the drawings and described in the specification are intended to be encompassed by the present invention.

What is claimed is:

1. Aerophone toy building blocks to construct an aerophone musical instrument, comprising:

a. a plurality of building blocks, each said block having four side walls, a top wall and an open bottom to make an inner space;

b. said top wall having releasable couplers to connect to other building blocks;

c. each said block having a plurality of airway channels inside said inner space;

d. a plurality of aerophone instrument components connected either onto or inside of the body of said plurality of building blocks;

e. each said block further having a plurality of apertures on said side walls and said top wall to connect said airway channels of the block with the airway channels of its adjacent blocks or to said aerophone instrument;

f. said blocks comprise of a larger block which creates lower pitched sounds and a smaller block which creates higher pitched sounds; and g. an air source to be attached to said plurality of building blocks to provide an air flow to said plurality of blocks, whereby said building blocks are connected to each other such that said airway channels of adjacent blocks are connected to deliver a continuous stream of air and to build various aerophone instruments.

2. Aerophone toy building block of claim 1, wherein said releasable couplers are designed to couple the top wall of a first block with the open bottom of a second block.

3. Aerophone toy building block of claim 1, wherein said blocks comprise of a plurality of blocks which is made of a same material and a plurality of blocks which is made of a different material to let the instrument produces different sounds.

4. Aerophone toy building block of claim 1, wherein said apertures on the building blocks have a different size and a different shape to achieve various sounds and amplifications.

5. Aerophone toy building blocks of claim 1, wherein said building blocks further have a sealing means to prevent air leakage in between two adjacent building blocks to force the airflow through connected airway channels.

6. Aerophone toy building blocks of claim 5, wherein said sealing means comprises of a plurality of grooves in said walls, each said groove is sized to receive a washer, whereby an O-ring type of seal can be formed between the adjacent blocks.

7. Aerophone toy building blocks of claim 1, wherein said air source being selected from the group consisting of a hand pump, a foot pump, a compressed air pump, or a user's mouth to blow air.

8. Aerophone toy building blocks of claim 1, further having any one of a reed bearing mouth piece, a horn instrument mouth piece, a membrane bearing mouthpiece, a tubular round mouth piece, a flat mouthpiece, or a hollow mouthpiece, to allow a user to blow air into said building blocks.

9. Aerophone toy building blocks of claim 1, wherein said aerophone musical instrument is a melodica, said melodica constructed by connecting a plurality of said aerophone building blocks, wherein each said building block has a reed instrument comprising of a key on the top of said aerophone building block, a spring hinged mechanism connected to said key, and an aperture for the air flow on the top of the block, whereby pressing said key opens said aperture allowing air to flow through said reed instrument to make a sound.

10. Aerophone toy building blocks of claim 1, wherein said aerophone musical instrument is a flute, wherein said flute comprises of an elongated body constructed by attaching a plurality of aerophone blocks to each other, wherein said plurality of blocks are selected from a group of blocks having an aperture on their top or having no aperture on their top (a mute block), and wherein a first block having a mount piece for a user to blow air into said elongated body, whereby opening and closing of said apertures creates a flute type sound.

11. Aerophone toy building blocks of claim 1, wherein said musical instrument is a clarinet, wherein said clarinet comprises of an elongated body constructed by selectively attaching a plurality of mute blocks having no aperture on the top and clarinet blocks to each other, wherein each said clarinet block having a reed instrument comprising of a key on the top of said aerophone building block, a spring hinged mechanism connected to said key, and an aperture for the air flow on the top of the block, said elongated body further having a first block having a mount piece and a last block having a horn-shaped end, whereby pressing each said key opens said aperture allowing air to flow through said reed and the horn-shaped end to create a clarinet sound.

12. Aerophone toy building blocks of claim 1, wherein said musical instrument is a harmonica, said harmonica comprising of a plurality of harmonica blocks, wherein each harmonica block comprising of said building block further having a comb with reed-plates and cover-plates mounted on said building block, said reed-plates being flat elongated springs which are secured at one end over the top aperture of said building block to provide air into said harmonica, whereby a free end of said reed-plates are made to vibrate by the airflow produced by a user.

13. Aerophone toy building blocks of claim 1, wherein said musical instrument is a hand pump, said hand pump comprised of an elongated bellow beneath of a plurality of reed portions, wherein said bellow provides air to said reed portion producing a tone or whistling sound.

14. Aerophone toy building blocks of claim 1, wherein said musical instrument is selected from the group consisting of a a melodica, a harmonica, a flute, a clarinet and a hand pump, constructed by selectively attaching building blocks providing any one of melodica, harmonica, flute, clarinet, or hand pump.

15. Aerophone toy building blocks of claim 1, wherein said musical instrument is a foot pump having a base to navigate an air flow to said plurality of building blocks.

16. Aerophone toy building blocks of claim 1, wherein said building block material being selected from the group consisting of bamboo, wood, plastics, fiberglass, copper, brass, aluminum, iron, steel, stone, recycled compounds or plant-fiber.

17. Aerophone toy building blocks of claim 1, wherein said releasable couplers selected from the group consisting of male and female couplers, hook and loop couplers or magnetic connectors.

18. Aerophone toy building blocks of claim 1, wherein said blocks can be moved into different positions, allowing the user to locate the notes or instrument in a desired position.

19. Aerophone toy building blocks of claim 1, wherein the size, the shape and the number of the blocks and the apertures in each block are selected to provide a desired number of the octaves required in the instrument.

* * * * *